US005474234A

United States Patent [19]

Maley

[11] Patent Number: 5,474,234

[45] Date of Patent: Dec. 12, 1995

[54] ELECTRICALLY CONTROLLED FLUID CONTROL VALVE OF A FUEL INJECTOR SYSTEM

[75] Inventor: Dale C. Maley, Fairbury, Ill.

[73] Assignee: Caterpillar Inc., Peoria, Ill.

[21] Appl. No.: 215,526

[22] Filed: Mar. 22, 1994

[51] Int. Cl.[6] ..... F02M 55/00; F02M 51/00

[52] U.S. Cl. ..... 239/88

[58] Field of Search ..... 239/88–91, 95; 251/129.01, 129.02, 129.15, 129.16

[56] References Cited

U.S. PATENT DOCUMENTS

| | | | |
|---|---|---|---|
| 2,144,862 | 1/1939 | Truxell, Jr. . | |
| 2,552,445 | 5/1951 | Nielsen . | |
| 2,621,011 | 12/1952 | Smith | 251/27 |
| 2,916,048 | 12/1959 | Gunkel | 137/544 |
| 3,532,121 | 10/1970 | Sturman et al. | 137/625.4 |
| 3,570,806 | 3/1971 | Sturman et al. | 251/65 |
| 3,570,807 | 3/1971 | Sturman et al. | 251/65 |
| 3,570,833 | 3/1971 | Sturman et al. | 267/161 |
| 3,585,547 | 6/1971 | Sturman et al. | 335/227 |
| 3,604,959 | 9/1971 | Sturman | 310/12 |
| 3,680,782 | 8/1972 | Monpetit et al. | 239/96 |
| 3,683,239 | 8/1972 | Sturman | 317/150 |
| 3,743,898 | 7/1973 | Sturman | 317/154 |
| 3,753,547 | 8/1973 | Topham | 251/120 |
| 3,814,376 | 6/1974 | Reinicke | 251/129 |
| 3,821,967 | 7/1974 | Sturman et al. | 137/624.15 |
| 3,835,829 | 9/1974 | Links | 123/139 E |
| 3,989,066 | 11/1976 | Sturman et al. | 137/624.2 |
| 4,107,546 | 8/1978 | Sturman et al. | 307/141 |
| 4,108,419 | 8/1978 | Sturman et al. | 251/30 |
| 4,114,647 | 9/1978 | Sturman et al. | 137/624.2 |
| 4,114,648 | 9/1978 | Nakajima et al. | 137/625.5 |
| 4,248,270 | 2/1981 | Ostrowski | 138/45 |
| 4,365,747 | 12/1982 | Knapp et al. | 239/125 |
| 4,392,612 | 7/1983 | Deckard et al. | 239/88 |
| 4,409,638 | 10/1983 | Sturman et al. | 361/152 |
| 4,418,867 | 12/1983 | Sisson | 239/88 |
| 4,482,094 | 11/1984 | Knape | 239/88 |
| 4,501,290 | 2/1985 | Sturman et al. | 137/495 |
| 4,516,600 | 5/1985 | Sturman et al. | 137/495 |
| 4,518,147 | 5/1985 | Andresen et al. | 251/121 |
| 4,526,519 | 7/1985 | Mowbray et al. | 417/490 |
| 4,541,454 | 9/1985 | Sturman et al. | 137/505 |
| 4,558,844 | 12/1985 | Donahue et al. | 251/118 |
| 4,653,455 | 3/1987 | Eblen et al. | 123/506 |
| 4,702,212 | 10/1987 | Best et al. | 123/472 |
| 4,794,890 | 1/1989 | Richeson, Jr. | 123/90.11 |
| 4,811,221 | 3/1989 | Sturman et al. | 364/420 |
| 4,813,599 | 3/1989 | Greiner et al. | 239/456 |
| 4,831,989 | 5/1989 | Haines | 123/506 |
| 4,846,440 | 7/1989 | Carlson et al. | 251/129.17 |
| 4,932,632 | 6/1990 | Nicol | 251/129.02 |
| 4,964,571 | 10/1990 | Taue et al. | 239/88 |
| 4,993,637 | 2/1991 | Kanesaka | 239/96 |
| 5,050,543 | 9/1991 | Kawamura | 123/90.11 |
| 5,109,885 | 5/1992 | Tauscher | 251/129.02 |
| 5,121,730 | 6/1992 | Ausman et al. | 123/467 |
| 5,131,624 | 7/1992 | Kreuter et al. | 251/129.18 |

FOREIGN PATENT DOCUMENTS

| | | | |
|---|---|---|---|
| 0246373 | 3/1992 | European Pat. Off. . | |
| 839743 | 5/1952 | Germany | 239/89 |

*Primary Examiner*—Karen B. Merritt

*Attorney, Agent, or Firm*—Marshall, O'Toole, Gerstein, Murray & Borun

[57] ABSTRACT

A fluid valve for controlling a high pressure fluid including a non-resilient valve seat with a flat seating surface. A non-resilient valve member has a concave end with an annular knife edge to sealingly engage the flat seating surface. A barrel slidably guides the valve member in movements with respect to the valve seat and forms a fluid chamber with the valve seat. The valve seat includes passageways between a high pressure valve inlet and the fluid chamber and between the fluid chamber and a valve outlet. An electrical actuator is operably energized to move the valve member into sealing engagement with the valve seat and return means disengage the valve member from the valve seat. The electrical actuator and valve member are part of an electronically-controlled fuel injector system with an injector body, a fuel injection pumping assembly with a nozzle receiving fuel from a fuel inlet to inject the fuel under pressure, and a pressure control valve assembly for controlling the fuel injection.

10 Claims, 2 Drawing Sheets

ELECTRICALLY CONTROLLED FLUID CONTROL VALVE OF A FUEL INJECTOR SYSTEM

TECHNICAL FIELD

The present invention relates generally to fluid control valves and, more particularly, to valve seats with high pressure sealing capability as used, for instance, in electronically-controlled fuel injectors and pressure control valves therefor.

BACKGROUND ART

Fluid control valves are used in a variety of environments to open and close a valve port, often under high pressure conditions. One example of a high pressure valve seal is shown for instance in U.S. Pat. No. 2,621,011 issued to T. R. Smith on Dec. 9, 1952. In this patent, a resilient sealing element or ring is provided with a resilient sealing, rounded lip for sealing contact with a flat seating surface on a valve plunger. The valve plunger compresses the resilient sealing member a predetermined amount in order to obtain a reliable seal of the fluid passing through the valve.

In many applications, rather than a resilient sealing contact between a metal member and a resilient or elastomeric sealing member, it is required to provide a metal to metal sealing contact, particularly in extremely high pressure environments were resilient members cannot be used effectively. One example of such high pressure valve sealing requirements is in fuel injection systems, such as electronically-controlled fuel injectors and pressure control valves therefor.

An example of an electrically-controlled fuel injector is shown in U.S. Pat. No. 4,392,612 issued to Deckard, et al. on Jul. 12, 1983. In Deckard, et al. the injector includes a mechanically-actuated fuel pumping plunger and an electrically-actuated fuel pressure control valve assembly. The pressure control valve assembly includes a solenoid-operated poppet valve that controls fuel pressure in the unit injector in order to control fuel injection delivery. Fuel pressure is controllably enabled to be developed within the injector by electrical actuation of the pressure control valve assembly. Fuel pressure is controllably prevented from developing within the injector by not electrically actuating the pressure control valve assembly.

In such electronically-controlled unit injectors, the armature of the pressure control valve assembly moves the metal poppet valve in one direction until it engages a metal valve seat and holds the poppet valve in the fuel sealing position to enable fuel pressure to be developed in the unit injector, eventually resulting in fuel injection. At the end of the fuel injection cycle, the solenoid is electrically deenergized and a return spring backs the poppet valve off of the valve seat and returns the poppet valve to the valve open position which prevents the development of fuel pressure by spilling the fuel back to the fuel reservoir.

Typically, such pressure or spill control valve assemblies use complimentary angled annular seating surfaces on the metal poppet valve and the metal valve seat to achieve the sealing engagement therebetween so as to shut off the fuel.

Several problems have been noted in these presently available pressure control valve assemblies and it is desired to seek solutions thereto. As an example, the sealing engagement of the normally provided angled surfaces between the metal poppet valve and the metal seat requires a given pressure which in turn requires that the electrical solenoid coil and the input electrical energy be sufficient to supply the given pressure. Such angled seat configuration also requires a given valve opening force in order to cause the poppet to move so as to thereby disengage the angled surface on the valve member from the angled surface on the valve seat.

If the poppet valve could be made to seat with less than the presently required electromagnetic force, the solenoid coil could be made smaller and require less electrical input energy. Similarly, on the valve opening cycle, if the required opening force on the poppet valve could be reduced, then the poppet valve would move more quickly in disengagement from the valve seat which would cause a sharper end of fuel injection. A sharper end of fuel injection is desired so as to provide higher engine thermal efficiency and lower exhaust emissions.

Also, because of the high pressure fluid conditions, it is desired to use non-resilient member to non-resilient member sealing rather than non-resilient member to resilient member sealing to avoid leakage problems encountered with using resilient seals in such high pressure fluid conditions.

It is therefore desired to provide a fluid valve for use in high pressure conditions which will overcome one or more of the problems as set forth above.

Disclosure of the Invention

In accordance with the principles of the present invention, there is provided a fluid valve assembly for use in controlling high fluid pressures and which includes a movable non-resilient valve member, such as a poppet valve, and a non-resilient valve seat with a flat seat sealing configuration. The movable non-resilient valve seat has a flat seating surface. The non-resilient valve member includes a concave end portion with a formed knife edge for sealing against the flat seating surface of the valve seat.

The concave end portion with a knife edge on the movable non-resilient valve member sealing against the flat seating surface of the non-resilient valve seat requires less force to seal a given pressure than in the case of presently available angled seat surfaces. Fluid is selectively communicated across the valve seat with the valve member controlling the opening and closing of the valve by controlled seating engagement with the valve seat. The concave-knife edge/flat seat sealing configuration enables the high pressure fluid inlet to provide a rapid valve opening force to thereby enable the fluid input to rapidly enter the fluid output portion of the seal.

In a preferred embodiment of the invention, a slidably movable poppet valve is slidably mounted and guided within a barrel guide. The poppet valve is formed of non-resilient material and includes a concave end portion with a knife edge for sealing against a flat seating surface on a non-resilient valve seat for controlling the flow of fluid between an inlet and an outlet coupled to the valve seat. A fluid chamber is defined at the junction of the barrel guide and the valve seat. The fluid chamber normally communicates the valve seat inlet to the valve seat outlet so that the fluid travels into the fluid chamber and across the seating area. Slidable movement of the poppet valve so that the concave-knife edge end of the poppet valve sealingly engages the flat seat sealing surface of the valve seat closes the valve assembly by shutting off the fluid chamber communication between the valve seat fluid inlet and the outlet of the valve seat.

A significant advantage of the improved valve seat of the present invention is that it is much easier to manufacture when compared to angled seats presently utilized in high pressure fluid control valve assemblies. The critical tolerances required for a successful valve seat are achievable using known manufacturing processes in high pressure control valves, such as in fuel injectors. For example, the flat seat sealing surface of the non-resilient valve seat must be extremely flat. This can be achieved by surface grinding and lapping. Secondly, the high pressure sealing land area formed between the barrel and the valve seat which defines the fluid chamber must be flat and perpendicular to the outer diameter of the valve member as well as perpendicular to the inner diameter of the barrel guide. This can be achieved by grinding the guide diameter and the sealing land at the guide barrel end in the same chucking of a high precision internal grinder. Lastly, the clearance between the outer diameter of the moving valve member, such as a poppet valve, and the inner diameter of the barrel guide must be very small and well controlled and this can be accomplished in a well known manner.

Furthermore, in the preferred embodiment of the invention, the knife edge is formed by the poppet valve outer diameter and a concave end surface which is formed at an acute angle of about 85° to the poppet valve exterior surface. It is preferred that the knife edge is formed annularly around the poppet valve concave end so that there is annular seating engagement between the knife edge and the flat seat sealing surface of the valve seat.

It is to be recognized that while the reversal of the positions of the concave end/knife edge and flat surface (i.e., forming the flat sealing surface on the poppet valve and forming the concave end/knife edge on the valve seat) is possible as a working configuration, manufacturing considerations weigh against such a configuration. The originally described configuration is therefore preferred because of the relative ease of manufacture compared to the reversed configuration.

BEST MODE FOR CARRYING OUT THE INVENTION

Figure 1:
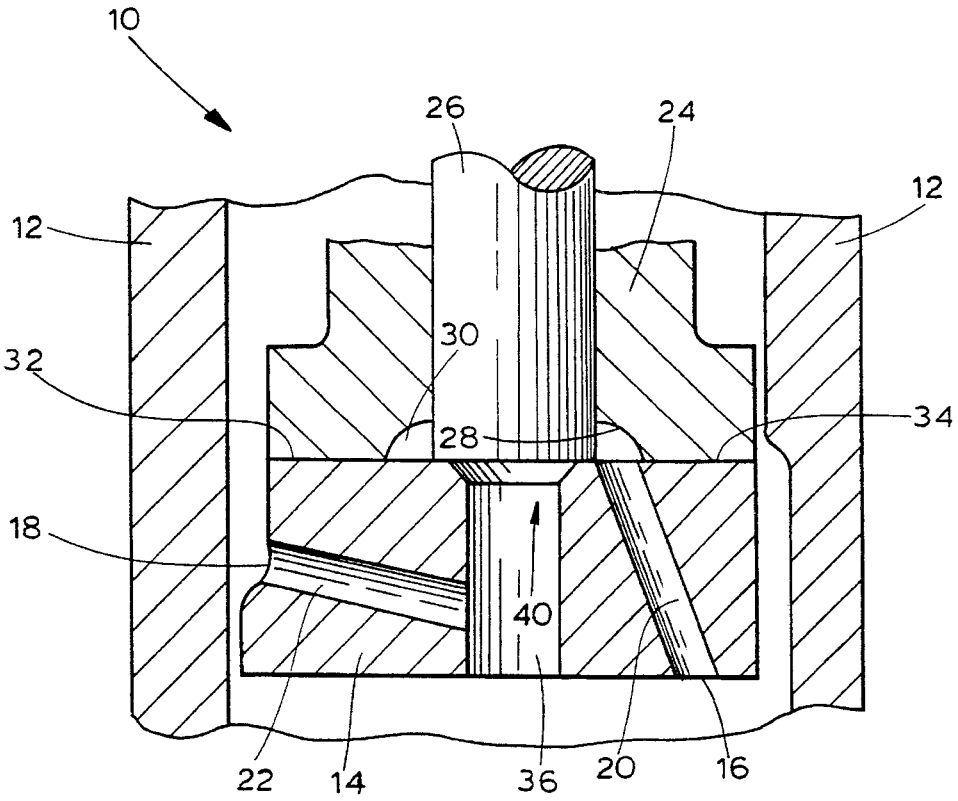
FIG. 1 is an elevational view illustrating a fluid valve for controlling high pressure fluids in accordance with the principles of the present invention.
Figure 2:
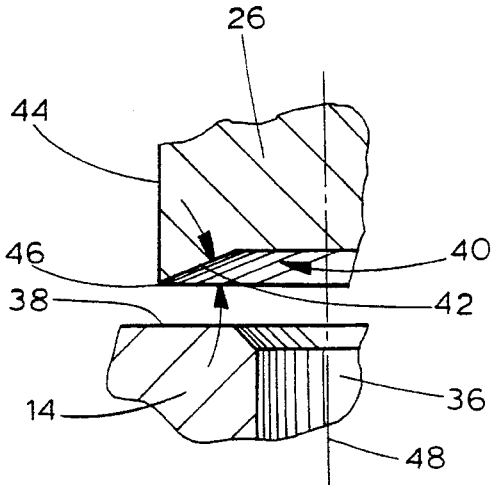
FIG. 2 is a fragmented sectional view illustrating a flat valve seat and a poppet valve having a concave end with a knife edge in accordance with the present invention.
Figure 3:
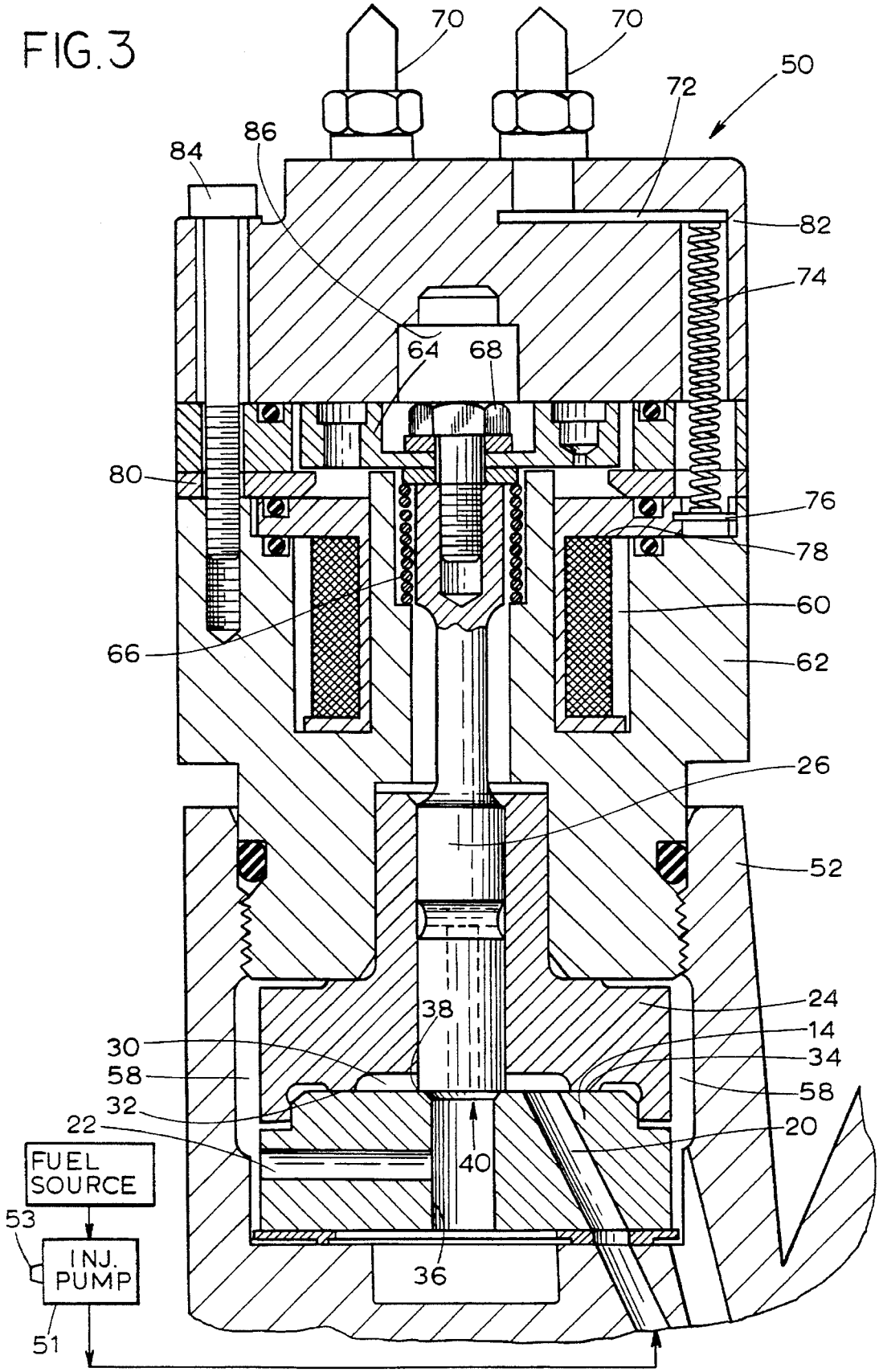
FIG. 3 is an elevational view of a pressure control valve assembly incorporating the fluid valve of FIGS. 1 and 2.

In drawing FIGS. 1–3, the same reference numerals designate the same elements for features throughout all of the drawings. FIG. 1 illustrates one embodiment of a fluid pressure control valve 10 useful for controlling the flow of high pressure fluid. Within valve body 12 there is mounted a valve seat 14 which includes a high pressure fluid inlet port 16 and a fluid outlet port 18. Valve seat 14 is formed of a non-resilient material such as metal and includes an internal passageway 20 communicating with the high pressure fluid inlet port 16 and an internal passageway 22 communicating with the fluid outlet port 18.

A barrel guide 24 includes a hollow cylindrical shaped interior bore adapted to accommodate and guide a valve member such as poppet valve 26 cylindrically shaped for slidable movement within the barrel guide 24. The valve member is also formed of a non-resilient material such as metal. Barrel guide 24 also includes a cavity 28 for defining a fluid chamber 30 between the bottom end of the barrel guide 24 and the opposite surface of valve seat 14. The opposite contacting surfaces forming sealing land areas at each of the junctions 32, 34 between the end of the barrel guide 24 and the opposite surface of the valve seat 14 are adapted to provide a seal at the joint for the fluid chamber 30. Accordingly, when the poppet valve 26 is in a raised position spaced from the valve seat 14, any high pressure fluid at the fluid inlet port 16 communicates through the passageway 20, and the fluid chamber 30, a central aperture 36, and the passageway 22 to the fluid outlet port 18.

As shown in FIG. 2, the valve seat 14 includes a flat seating surface 38 which sealingly mates with the bottom end of the valve member 26 as shown in the closed valve position of FIG. 1. In FIG. 2 the valve is shown in an open position to illustrate the improved valve sealing structure of the present invention. The poppet valve 26 includes a concave end portion 40 wherein end surface 42 is preferably formed at about an 85° angle to an exterior outer diameter surface 44 of the poppet valve 26 thereby providing an annular knife edge 46 at the intersection between end surface 42 and the exterior surface 44. It is understood, of course, that the valve seat 14 and the poppet valve 26 are respectively symmetrically shaped with respect to centerline 48, at least with respect to the valve sealing structure.

The flat seating surface 38 and the concave end portion 40 having the annular knife edge 46 is easier to construct than present valve seats used for on/off fluid delivery control of high pressure fluids. All of the valve components in the sealing structure are formed of non-resilient material. Preferably the valve seat 14, the barrel guide 24 and the poppet valve 26 are all formed of a suitable metal or metals. The critical manufacturing tolerances required for a reliable seat can be achieved using known manufacturing processes for high pressure fluid devices, such as for instance as used for fuel injectors. For example, the flat seating surface 38 must be extremely flat. This can be achieved by surface grinding and lapping. Also, the bottom surface of the barrel guide at the junctions 32, 34 must be flat and perpendicular to the centerline of the barrel guide 24 because the poppet valve 26 is guided in the barrel diameter. This requirement can be achieved by grinding the barrel diameter and the bottom surfaces of the barrel guide 24 at the junctions 32, 34 in the same chucking of a high precision internal grinder. Finally, the annular or diametrical clearance between the outer diameter of the poppet valve 26 and the inner diameter of the barrel guide 24 must be very small and well controlled and can readily be achieved by manufacturers of high pressure fluid control valves, such as diesel engine fuel system manufacturers.

Referring now to FIG. 3, there is illustrated a pressure control valve assembly 50 for a fuel injector. Pressure control valve assembly 50 includes fluid control valve 10 of FIGS. 1 and 2 so as to provide the rapid on/off action desired for use in an electronically-controlled fuel injector system. A fuel injection pumping assembly 51 is provided for controlling fuel injection delivery through a nozzle. It is to be understood that fluid control valve 10 can be applied to a variety of applications where it is desired to control the flow of high pressure fluid. The following description involves the application of fluid control valve 10 in a unit injector fuel system which involves relatively high fuel pressures. Therefore this description is to be understood to be for purposes of illustrating an application of the present invention and is not to be used in a limiting manner.

Injector body 52 includes passages adapted to accommodate relatively high pressure fuel supply passage 54 and relatively low pressure fuel drain passage 56 each of which is coupled respectively to the valve seat fluid inlet port 16 and the valve seat fluid outlet port 18. An annular cavity 58 in the injector body 52 communicates with passageway 22 and in turn leads to the valve body fuel outlet 56.

A solenoid coil 60 is provided for moving the poppet valve 26 in the downward direction of FIG. 3 until the annular knife edge 46 engageably seals on the flat annular seating surface 38 of the valve seat 44. The solenoid coil 60 is mounted within a lower inner pole 62. An armature 64 is mounted at the top end of the poppet valve 26. A return spring 66 is mounted between the lower inner pole 62 and the armature 64 to exert an upward spring force against the armature so as to bias or lift the poppet valve 26 off of the valve seat 14.

Thus, with the valve 10 in the open position shown in FIG. 2, wherein the fuel inlet 54 communicates with the fuel outlet 56, the spring 66 would have lifted the poppet valve 26 off of the valve seat 14. A suitable stop bolt 68 with appropriate travel and gap shims on either sides of the armature 64 are provided to adjust the position of the poppet valve 26 with respect to the flat seating surface 38 of the valve seat 14.

Terminals 70 receive suitable electrical control signals in a well known manner and couple the signals to controllably operate the solenoid coil 60. In particular, the terminal 70 is mounted on a metal plate 72, with plate 72 connected by a spring electrical contact 74 to a coil plate 76 to which in turn is mounted a coil wire 78 of the solenoid coil 60. Cooperating with the lower inner pole 62 is a lower outer pole 80 which is maintained in position by means of a molded cap 82 held in position by a series of bolts 84. A stop member 86 acts as a stop for the continued upward movement of the valve member 26 due to the action of the return spring 66 when then stop bolt 68 contacts the stop 86.

In addition to the previously described ease of manufacturing of the flat seat/concave end with knife edge poppet valve of the present invention, this desirable configuration for application in controlling high pressure fluid flows, has additional advantages over angled seats used in presently available fuel injectors. The flat seat/concave end with knife edge valve member requires less vertical force to seal a given pressure than an angled seat. Thus, less magnetic force is required to seal a given pressure which in turn enables the solenoid coil to be smaller and thereby requiring less electrical input energy for operation. In addition, the improved flat seat valve of the present invention provides a sharper end of fuel injection which gives higher engine thermal efficiency and lower exhaust emissions. A sharper end of fuel injection is achieved because the flat seat configuration provides more opening force on the poppet valve than the prior angled seat configuration, thereby enabling the poppet valve or moving valve member to open more quickly. The flat seat configuration also enables higher injection pressures (for example, about 207 MPa or 30,000 p.s.i.) to be used which provides higher engine efficiency and lower emissions. Another benefit of the flat seat configuration is that less poppet valve stroke is required (for a given poppet diameter) to achieve the same flow rate by the seat than a conventional angled seat. Less poppet valve stroke means that the poppet valve can open and close faster which also improves engine thermal efficiency and emissions. Less poppet stroke also means less space requirements for the pressure control valve assembly.

Industrial Applicability

With reference to FIG. 3 as the fuel injector pumping assembly 51 of the unit injector forces fuel from a fuel source through a passage in the injector body 52 into the high pressure fuel supply passage 54, fuel under high pressure flows through passageway 20 and into the annular area in fluid chamber 30 below the barrel guide 24. Since fuel injection is not ready to begin as yet, the poppet valve 26 is in the unseated or up position and maintained in that position by the spring return 66. This allows the fuel to flow by the flat seat between the concave end portion 40 of the poppet valve and the flat seating surface 38 of the valve seat, with the fuel continuing through the central aperture 36, the transverse passageway 22 and into the annular cavity 58 in the injector body. The fuel flows around the annular cavity 58 until it reaches the valve outlet leading to the drain passage 56 where the fuel then flows back to a connection to the fuel gallery in the cylinder head of the engine. It is understood, of course, that during this time, the poppet valve 26 is maintained in the unseated or up position against the stop 86 by means of the return spring 66.

When it is time to start building fuel pressure for fuel injection, suitable electrical operating signals (such as a selected voltage) are supplied to the solenoid coil 60. An electromagnetic field is then created by which the coil causes a downwards force on the armature 64. When the developed coil electromagnetic field force on the armature in a downwards direction exceeds the opposite force upwards from the return spring 66, the armature 64 and the valve member 26 will begin to move downwards until the concave end portion 40 of the valve member contacts the valve seat 14. In this position, the non-resilient annular knife edge 46 depressingly engages the non-resilient flat annular seating surface 38 in a secure annular or circular seating contact and the knife edge is maintained against the flat seating surface by the electromagnetic force from the solenoid coil 60.

With the knife edge 46 contacting the flat seating surface 38, the valve seat is then closed, which stops the flow of fuel by the seat as shown in FIG. 3. Since fuel flow is stopped, pressure begins to build up and when the pressure reaches a predetermined nozzle valve opening pressure in the fuel injection pumping assembly 51, the fuel injection nozzle 53 is opened and fuel is injected into the engine combustion cylinder.

To stop or interrupt fuel injection, the operating voltage to the coil is removed in response to a waveform or command produced by an electronic control module (not shown). The electronic control module preferably includes processors and interfaces for reading one or more engine sensors (such as an engine crank position sensor) and performing the required calculations for fuel injection timing and quantity. The magnetic circuit created by the coil now begins to decay. Once the electromagnetic field has decayed to the point that the upwards spring force is greater than the downwards magnetic force on the armature, the poppet valve 26 begins to move upwardly away from the valve seat which opens the control valve assembly 50. The fuel under pressure in fluid chamber 30 then flows past the seat 14 and the injection pressure begins to decay. Once this pressure falls below nozzle valve closing pressure, injection of fuel into the respective engine combustion chamber is stopped.

The initial opening force on the valve member 26 is caused by the return spring 66. Once the annular knife edge 46 begins to move away from the flat seating surface 38 as the flat seat is opened slightly, the injection pressure in the fuel flowing across the seat 14 and immediately below the concave end portion 40 of the poppet valve, adds opening force to the poppet valve. This makes the control valve 10 open very fast, which gives a sharp end of the fuel injection. The poppet valve 26 continues traveling upwards until the stop bolt 68 contacts the stop member 86. The return spring 66 then holds the valve member 26 upwardly in the valve open position until the coil is again energized. This completes an injection phase or injection cycle as controlled by the control valve assembly 50.

Thus, the fluid control valve 10 of the present invention offers significant advantages in controlling high pressure fluid flows. The all non-resilient construction of the valve seat 14, the poppet valve 26 and the barrel guide 24 enables this control valve to be used in high pressure fluid flow control situations. Also, the annular knife edge 46, which makes an annular or circular line of sealing contact with the flat seating surface 38, provides the advantages of better high pressure fluid sealing capability, ease of manufacture, and lower costs. Furthermore, when the fluid control valve 10 is applied to high pressure fuel injection systems such as illustrated in connection with the pressure control valve assembly of FIG. 3, the improved valve of the present invention provides better control of the starting and the stopping of fuel injection which is a significantly desired feature in such systems.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

I claim:

1. A fluid pressure control valve adapted for an electronically-controlled fuel injector, comprising:

a valve body with a fluid inlet and a fluid outlet;

a valve seat formed of non-resilient material communicating with said fluid inlet and said fluid outlet, said valve seat having a flat seating surface;

a valve member formed of non-resilient material movably mounted in said valve body for movement with respect to said valve seat, said valve member having a sealing end sealingly engageable with said valve seat to block said fluid inlet from said fluid outlet; and said valve member sealing end including an exterior surface and having a concave end portion forming a knife edge perimeter with said exterior surface for sealingly engaging said knife edge perimeter on said flat seating surface of said valve seat;

said concave end portion including an interior end surface angled with respect to and intersecting said exterior surface to form said knife edge perimeter;

an electrical actuator adapted for mounting to said valve member and operably energized for moving said valve member into said sealing engagement with said valve seat; and return means coupled to said valve member to disengage said valve member from said valve seat.

2. The fluid pressure control valve of claim 1, wherein said valve seat is formed of metal.

3. The fluid pressure control valve of claim 2, wherein said valve member is formed of metal.

4. The fluid pressure control valve of claim 1, wherein said valve member sealing end and said concave end portion are cylindrical to form said knife edge perimeter as an annular perimeter.

5. The fluid pressure control valve of claim 4 wherein said interior end surface is angled at about 85 degrees with respect,to said exterior surface.

6. An electronically-controlled fuel injector system comprising:

an injector body having a fuel inlet and a fuel outlet;

a fuel injection pumping assembly, including a nozzle receiving fuel from said fuel inlet for injecting said fuel under pressure from said pumping assembly;

a pressure control valve assembly for controlling the injecting of said fuel, said control valve assembly including a valve seat having a valve seat inlet connected to said injector body fuel outlet and having a drain fuel outlet, said valve seat having a flat seating surface and formed of non-resilient material, said control valve assembly including, a valve member formed of non-resilient material movably mounted with respect to said valve seat, said valve member having a sealing end sealingly engageable with said valve seat to block said valve seat inlet from said drain fuel outlet; and said valve member sealing end including an exterior surface and having a concave end portion forming a knife edge perimeter with said exterior surface for sealingly engaging said knife edge perimeter on said flat seating surface of said valve seat;

said concave end portion including an interior end surface angled with respect to and intersecting said exterior surface to form said knife edge perimeter;

an electrical actuator adapted for mounting to said valve member and operably energized for moving said valve member into said sealing engagement with said valve seat; and return means coupled to said valve member to disengage said valve member from said valve seat.

7. The electronically-controlled fuel injector system of claim 6 wherein said valve seat is formed of metal.

8. The electronically-controlled fuel injector system of claim 7, wherein said valve member is formed of metal.

9. The fluid pressure control valve of claim 6, wherein said valve member sealing end and said concave end portion are cylindrical to form said knife edge perimeter as an annular perimeter.

10. The fluid pressure control valve of claim 9, wherein said interior end surface is angled at about 85 degrees with respect to said exterior surface.

* * * * *